US008528906B1

(12) United States Patent
Heaslip

(10) Patent No.: US 8,528,906 B1
(45) Date of Patent: Sep. 10, 2013

(54) BOARD GAME

(76) Inventor: William T. Heaslip, Thornhill (CA)

( * ) Notice: Subject to any disclaimer, the term of this patent is extended or adjusted under 35 U.S.C. 154(b) by 2521 days.

(21) Appl. No.: 10/916,490

(22) Filed: Aug. 12, 2004

(51) Int. Cl.
*A63F 3/00* (2006.01)

(52) U.S. Cl.
USPC ..... 273/243; 273/248

(58) Field of Classification Search
USPC ..... 273/243, 272, 299, 248, 278
See application file for complete search history.

(56) References Cited

U.S. PATENT DOCUMENTS 3,655,195 A * 4/1972 Bean et al. ..... 273/272
4,331,333 A * 5/1982 Willcocks ..... 273/238
4,591,161 A * 5/1986 Vanderhoof ..... 273/272
4,892,319 A * 1/1990 Johnson, II ..... 273/272
4,934,711 A * 6/1990 Runstein ..... 273/272
5,230,515 A * 7/1993 Cohen ..... 273/261
5,564,710 A * 10/1996 Bolding et al. ..... 273/299
5,820,125 A * 10/1998 Olsen ..... 273/248
6,491,300 B2 * 12/2002 Harris et al. ..... 273/272
6,986,513 B1 * 1/2006 Ferrante ..... 273/272

* cited by examiner

*Primary Examiner* — Vishu K. Mendiratta

(57) ABSTRACT

A game board has a grid of playable points with some of the playable points bearing indicia. At least two tokens are provided for moving along the grid and at least two display panels are provided, each having areas for showing indicators of the indicia. If a token ends a move on one of the indicia bearing playable points, the player receives an indicator of the indicia and shows this indicator on one of the areas of said player's display panel. Movement may be along adjacent playable points in any available direction in either a straight line path or along a path that comprises two straight line segments that make an angle with each other.

4 Claims, 9 Drawing Sheets

BOARD GAME

BACKGROUND OF INVENTION

This invention relates to a game played on a board.

While numerous board games exist, the following characteristics can make a game engaging for teenage or adult players: a requirement for strategising, interesting tactics, a reasonable pace of play, and a luck element. This invention seeks to provide a board game providing these characteristics.

SUMMARY OF INVENTION

A game board has a grid of playable points with some of the playable points bearing indicia. At least two tokens are provided for moving around the grid and at least two display panels are provided, each having areas for showing indicators of the indicia. If a token ends a move on one of the indicia bearing playable points, the player receives an indicator of the indicia and shows this indicator on one of the areas of said player's display panel.

Conventional dice board games have well defined objectives and players are constrained by board geometry in seeking to achieve those objectives. This invention seeks to provide board games where a player may set his own objectives within the general scope of a specific game. Typically, the games may provide a player with a large degree of freedom to move about the board to accomplish those objectives. Thus, in an embodiment, a player may move in any of a variety of directions and make one change of direction in the course the move. The player may also have some flexibility with respect to the length of any move. The games may be designed to be highly interactive with a player having the option of interfering with an opponent's progress rather than advancing his own position. With these games, it is possible to award points for value of the accomplishment of the objectives and for first to finish. A number of bonus opportunities may be provided to add to game interest. The closing requirements of the playing system may ensure that all players are actively involved and potential winners right up to the final play. The various characteristics of the games, which can require strategizing and tactical judgement, and which can provide a reasonable pace of play and a luck element, can result in games that are engaging for an adult player.

Accordingly, the present invention provides a game comprising: a game board having a grid of playable points, some of said playable points of said grid bearing indicia; at least two tokens for moving along said grid of playable points; at least two display panels having areas for showing indicators of said indicia; a set of instructions comprising a first instruction indicating that, at least for certain indicia bearing playable points, if a token ends a move on one of said indicia bearing playable points, said player is to receive an indicator of said indicia and show said indicator on one of said areas of said player's display panel.

Accordingly, the present invention provides a game comprising: a game board having a grid of playable points, some of said playable points of said grid bearing indicia; at least one number generator; at least two tokens for moving along said grid of playable points; a set of instructions comprising a first instruction indicating that on a move, a player is to generate at least one generated number using said at least one number generator and then move a token along a determined number of adjacent playable points on said grid in any available direction, where said determined number is related to said at least one generated number, such that said move is either in a straight line or comprises two straight line segments which make an angle with each other.

In accordance to another aspect of the present invention, there is provided a method of playing a game having a game board having a grid of playable points, some of said playable points of said grid bearing indicia, at least two tokens for moving along said grid of playable points, and at least two display panels having areas for showing indicators of said indicia, comprising: on a move of a player, at least for certain indicia bearing playable points, where a token ends a move on one of said indicia bearing playable points, said player receiving an indicator of said indicia and showing said indicator on one of said areas of said player's display panel.

These and other features of the invention will become apparent from a review of the drawings and the accompanying description.

DESCRIPTION OF FIGURES

In the figures which illustrate example embodiments of the invention.

DETAILED DESCRIPTION

Figure 1:
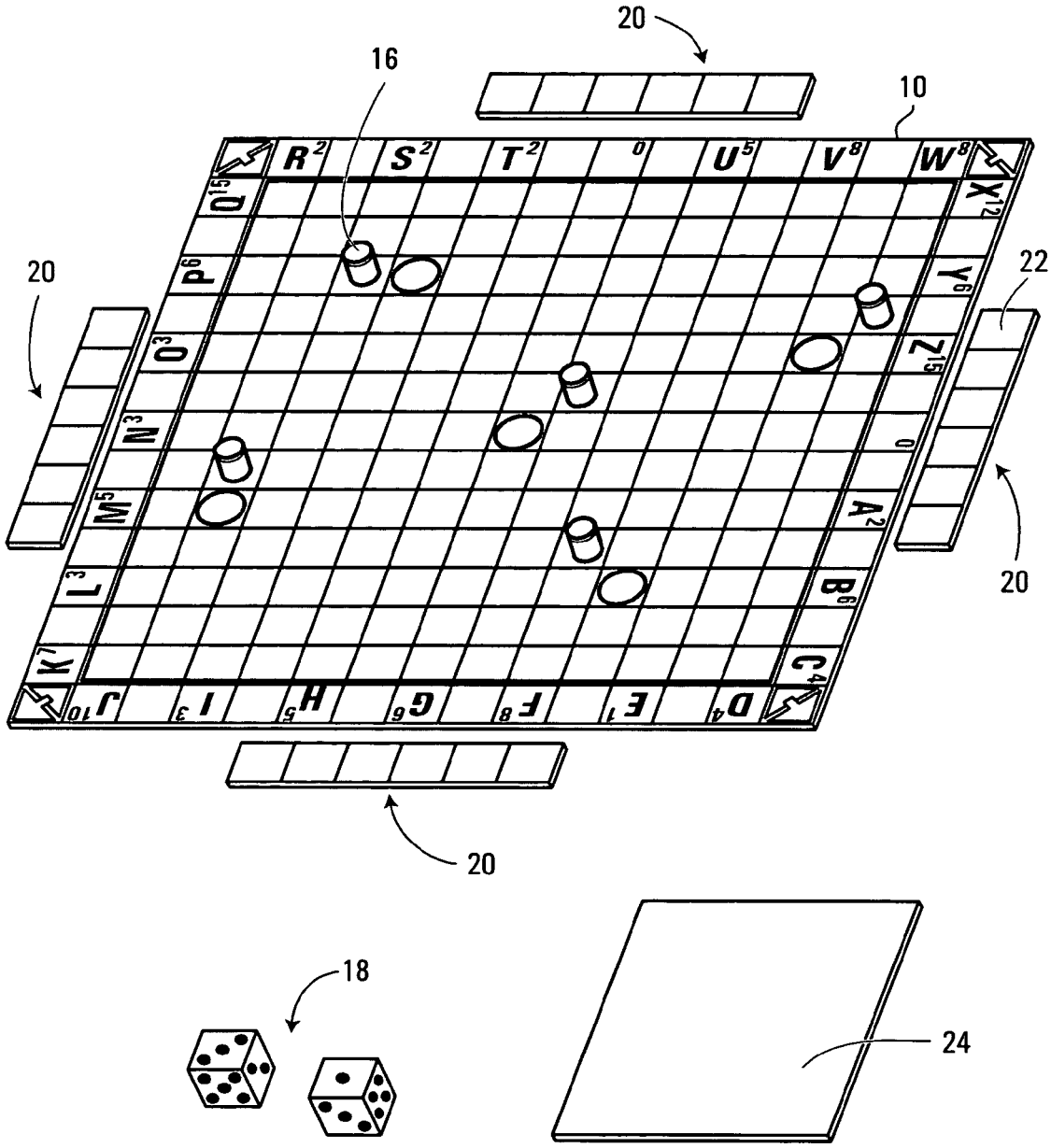
FIG. 1 is a representation of a game made in accordance with this invention.
Figure 2:
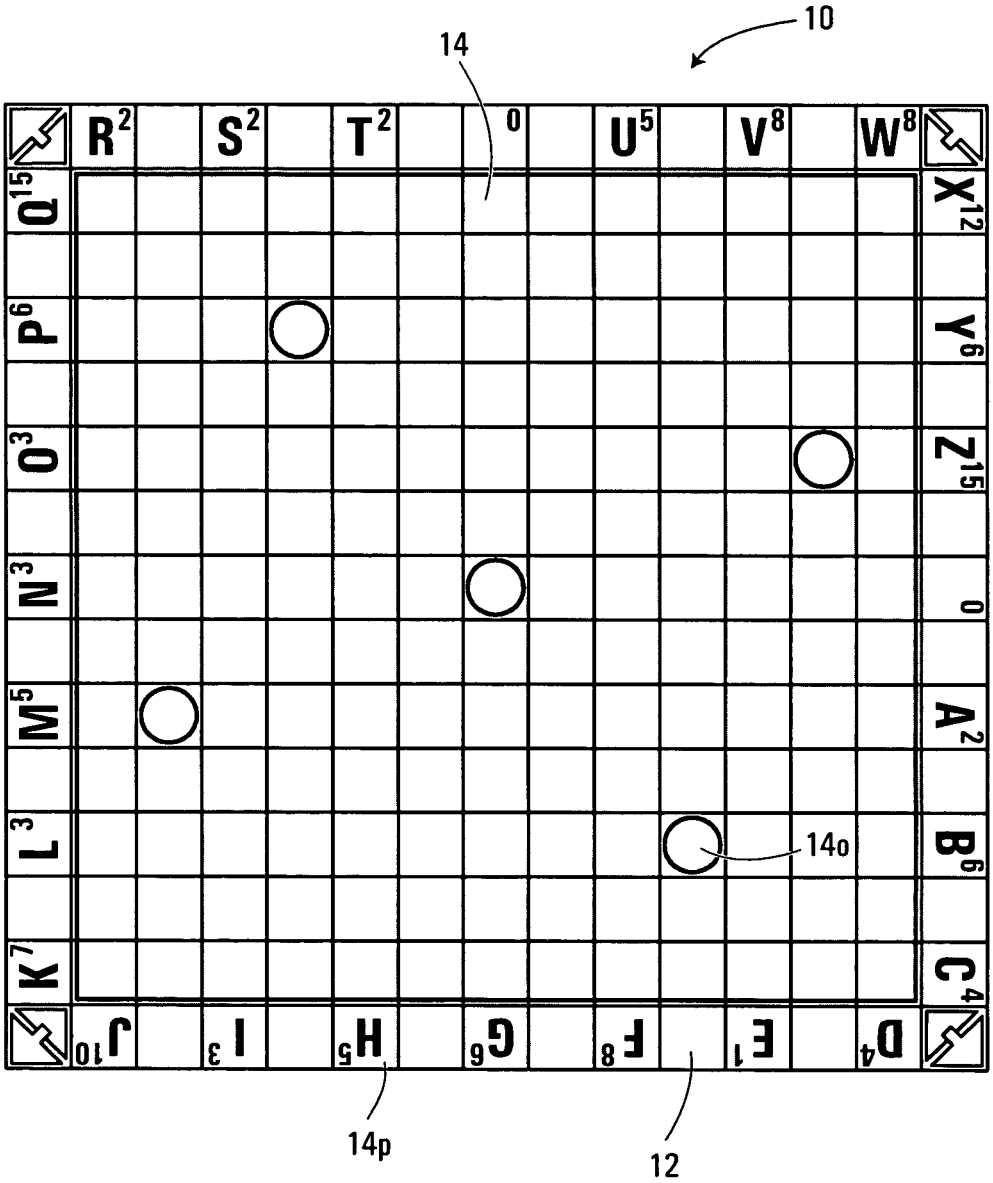
FIG. 2 is a representation of a game board made in accordance with an embodiment of this invention.

Turning to FIGS. 1 and 2, a game board 10 has a grid 12 of playable points 14. In the example shown, the grid is a 15×15 square matrix where each of the playable points is a playable square. Many of the peripheral playable points 14*p* (i.e., the squares along the outer boundary of the grid) bear indicia. Specifically, the letters of the alphabet appear in peripheral playable points 14*p* along with a numerical value which associates a numerical value with each letter. Additionally, two of the peripheral playable points lack a letter and show a number—the number 0—these peripheral points represent blanks. The corner peripheral playable points bear arrows designating these points as grid entrances and exits. Other playable points 14*o*, which bear circles are considered benefit points for reasons which will become apparent.

The game board 10 is used with tokens 16, with each token being sized to allow placement on one of the playable points. To play a game on the board, one or more number generators, such as a pair of dice 18, are also used. Further, a number of display panels 20, such as erasable boards or simply pieces of paper, are employed. These display panels may have a fixed number of spaces 22 for letters and may be shaped or coloured so as to be positively identified with one of the tokens 16.

A set of instructions 24 is provided to indicate the method of play. The instructions can indicate that each player selects a token 16 which starts at a corner playable point of the grid 12. Optionally, the corners and tokens may be colour-coded so that a token may only enter or exit the grid at the corner playable point of like colour. On a turn, a player is to generate at least one generated number using the number generator(s). The player then moves his token along adjacent playable points on the grid, where the number of playable points moved is related to the generated number(s). The instructions may provide that the move is either in a straight line or comprises two straight line segments which make an angle with each other. The permitted angle between the two straight line segments may be at a right angle or, in another embodiment, at a forty-five degree angle. Where the straight line segments may make a right angle, the instructions may provide that diagonal moves are not permitted (i.e., each straight line move and each straight line segment of a move must be laterally oriented on the grid). Alternatively, diagonal moves may be permitted.

In one embodiment, the number generator(s) may be a pair of dice and the instructions may provided that a player may move a number of adjacent playable points equal to either the sum of, or the magnitude of the difference of, the numbers showing on these two dice.

The instructions may provide that access and egress to any peripheral point is only available from non-peripheral playable points and may further provide that unmarked peripheral points are not available for play.

Figure 3:
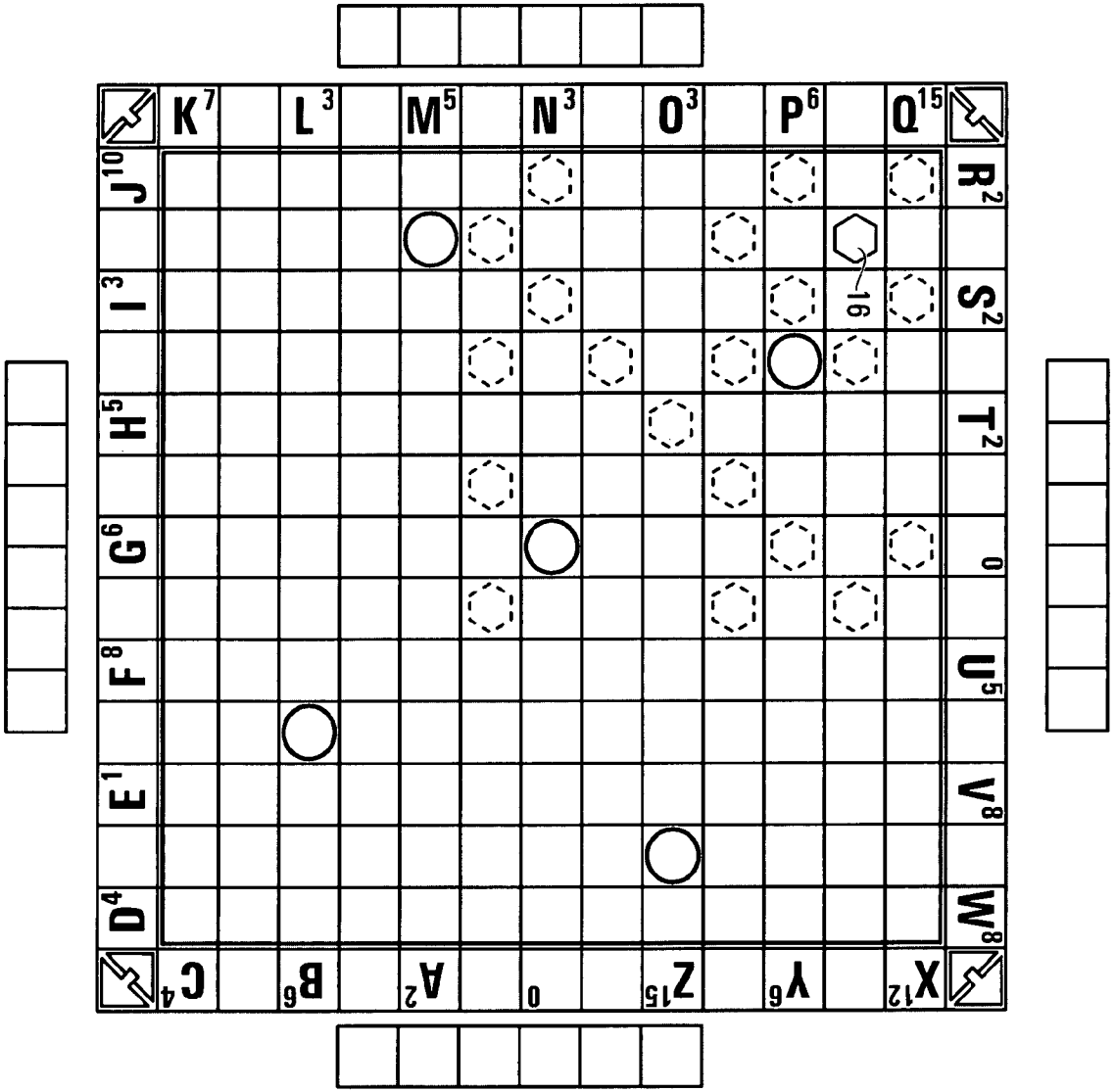
FIG. 3 is a representation of the game board of FIG. 2 illustrating token movement.

FIG. 3 illustrates the resulting flexibility in movement, assuming that diagonal moves are permissible and the permitted angle between two straight line segments is a right angle. Turning to FIG. 3, if a token 16 is placed as shown and a four and a two are rolled, the token 16 may move to any of the end positions shown by the ghost tokens.

The instructions may provide that a token may not move over a playable point occupied by another token and further that if a move of a token ends on a playable point occupied by another token, the other token may be displaced to any other vacant playable point on the grid at the election of the player making the move. If no legal move is possible, a player forfeits his turn.

The instructions may further provide that if a token ends a move on a peripheral playable point 14*p* bearing a letter or a designated blank, the player receives an indicator of the letter or blank. This may be accomplished by the player recording the letter or blank on an empty space of his display panel 20. The instructions may provide that once a letter or blank is recorded, it cannot be moved to a different position on the panel. The instructions may provide that a player who ends a move on a peripheral playable point bearing a letter or blank is awarded another turn. The instructions may provide that a player continues in this fashion until he has recorded an acceptable set of letters on his display panel, such as a five or six letter word. Acceptable words may be, for example, ones that are found in a dictionary agreed to by the players. The instructions may also provide that each player's display panel must be positioned so that each letter (and blank) recorded on the panel is visible to the other players.

After a player has recorded an acceptable word, on his turn he endeavours to move his token off the grid through a designated grid exit. Optionally, a player may only exit on an exact count (i.e., when the sum or difference of the generated numbers equal the number of playable points up to the corner exit point). When a player succeeds in moving off the grid, a round of play ends. Points may then be awarded to the exiting player equal to the sum of the numbers associated with each of the letters in the players acceptable word. Optionally, the exiting player may also receive a number of bonus points, in which case the remaining players may be credited with points for the letters they have acquired, provided they can articulate an acceptable word having these letters in this order.

The benefit points 14*o* may be used to provide a player with special benefits. For example, if a move ends on a benefit point 14*o*, another move may be awarded to the player and/or a player may receive one or more bonus points. Or if a move ends on the central benefit point 14*o*, a player may be entitled to move his token to any other playable point on the board. An exception to this latter rule may be provided such that this benefit only accrues if the player has not already recorded an acceptable word. A roll of doubles could also entitle a player to another move and such a benefit could be combinable with a benefit that accrues on ending a move on a benefit point 14*o*. If benefits are combinable and a player acquires a letter or blank by landing, on exact count, on a peripheral point 14*p* he earns an additional turn but it may be that any other accumulated extra turns are forfeited.

Figure 4A:
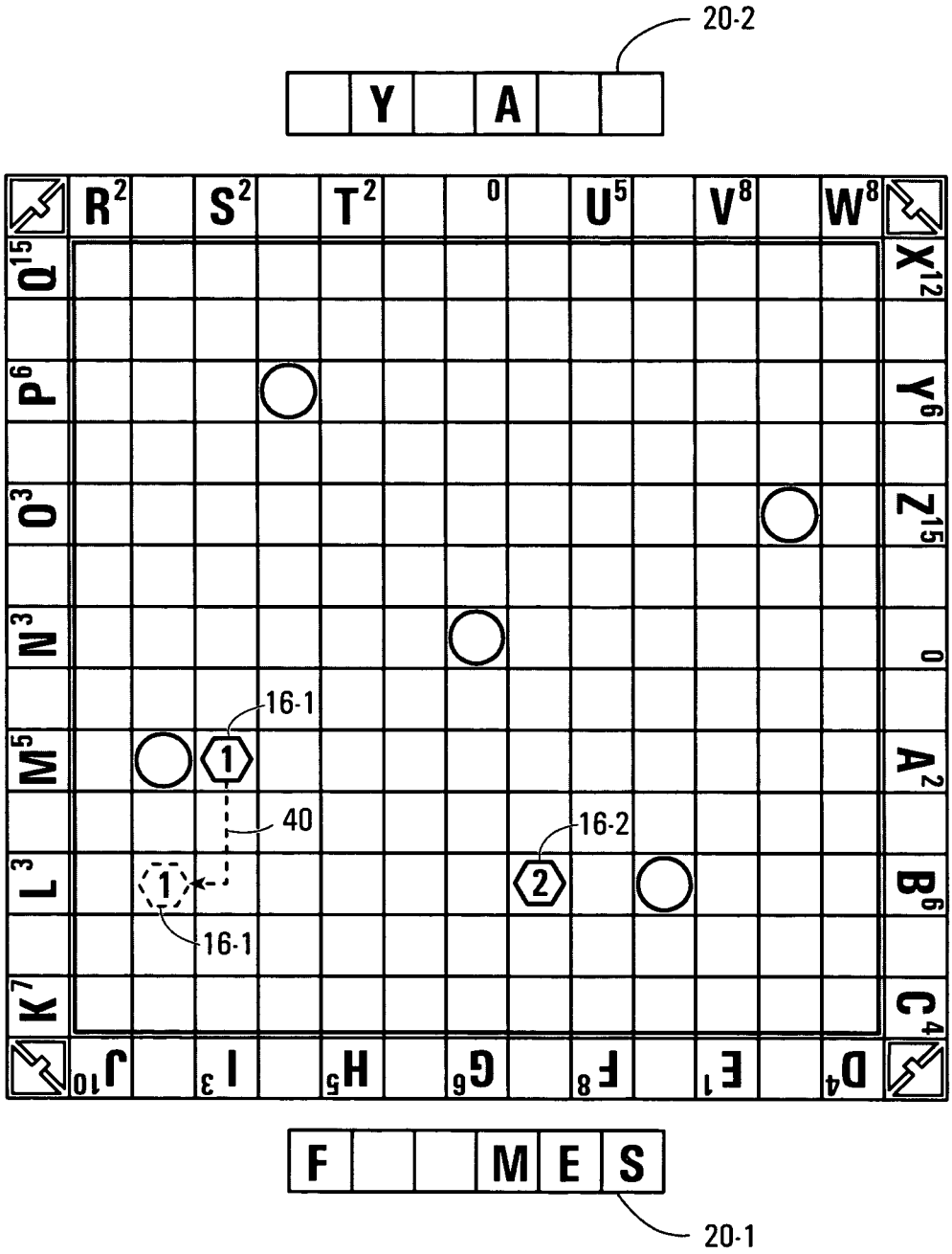
FIGS. 4A to 4E are representations of a game made in accordance with this invention to show progression of a hypothetical game.

Advantages of the game as described may become more apparent by considering a few turns of players in a hypothetical game. Assume that a game with two players has progressed to the stage indicated at FIG. 4A and that it is the turn of player 1. It will be noted that player 1 currently has an "F" showing in the first letter position of his display panel 20-1 and the letters "MES" showing in the last three letter positions of his display panel. These letters are visible to the other player, but she may not know what word player 1 has in mind. Let us say, player 1 has in mind the word "FLAMES". Player 1 may roll a 2 and a 1 on the dice. This allows player 1 to advance his token 16-1 either (2+1=) 3 squares (playable points) or (2−1=) 1 square. The peripheral point 14*p* bearing the needed letter "L" is five squares distant and that bearing the letter "A" is eleven squares distant. Thus, player 1 may choose to advance three squares toward the closer letter "L". Further, the rules may permit player one to make one right angled turn during his move and may permit diagonal moves. Thus, player 1 may negotiate his token along the path 40 to a final token position illustrated by phantom token 16-1. Player 1's turn then ends.

Figure 4B:
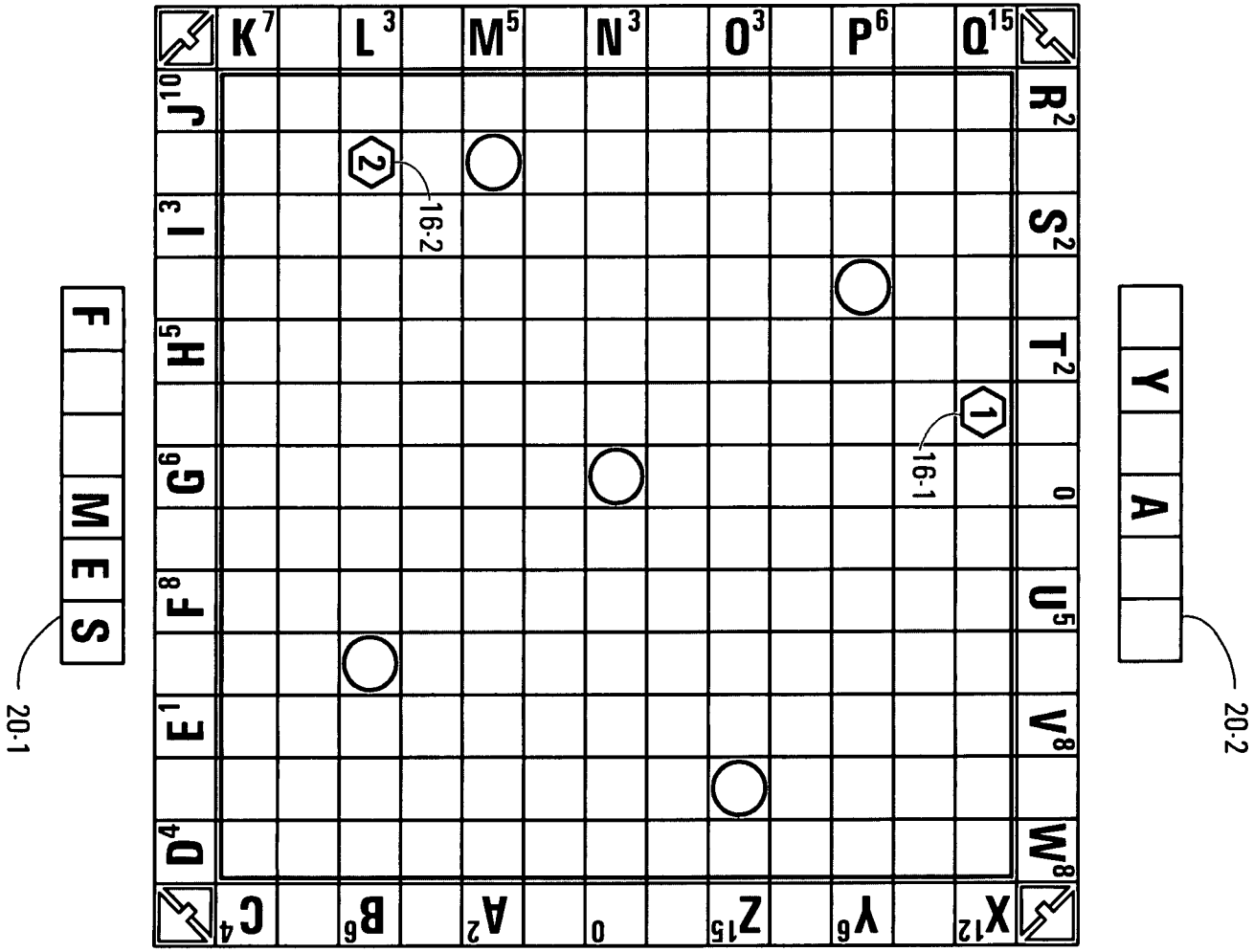

Player 2 may follow by rolling a 3 and a 3. Player 2 may have come to the conclusion that player 1 is trying to make the word "FLAMES" and, to hamper player 1, move six squares ending on top of player 1's token 16-1, whereupon player 2 is entitled to displace token 16-1 to any other playable point on the board. The end result may be as shown in FIG. 4B.

Figure 4C:
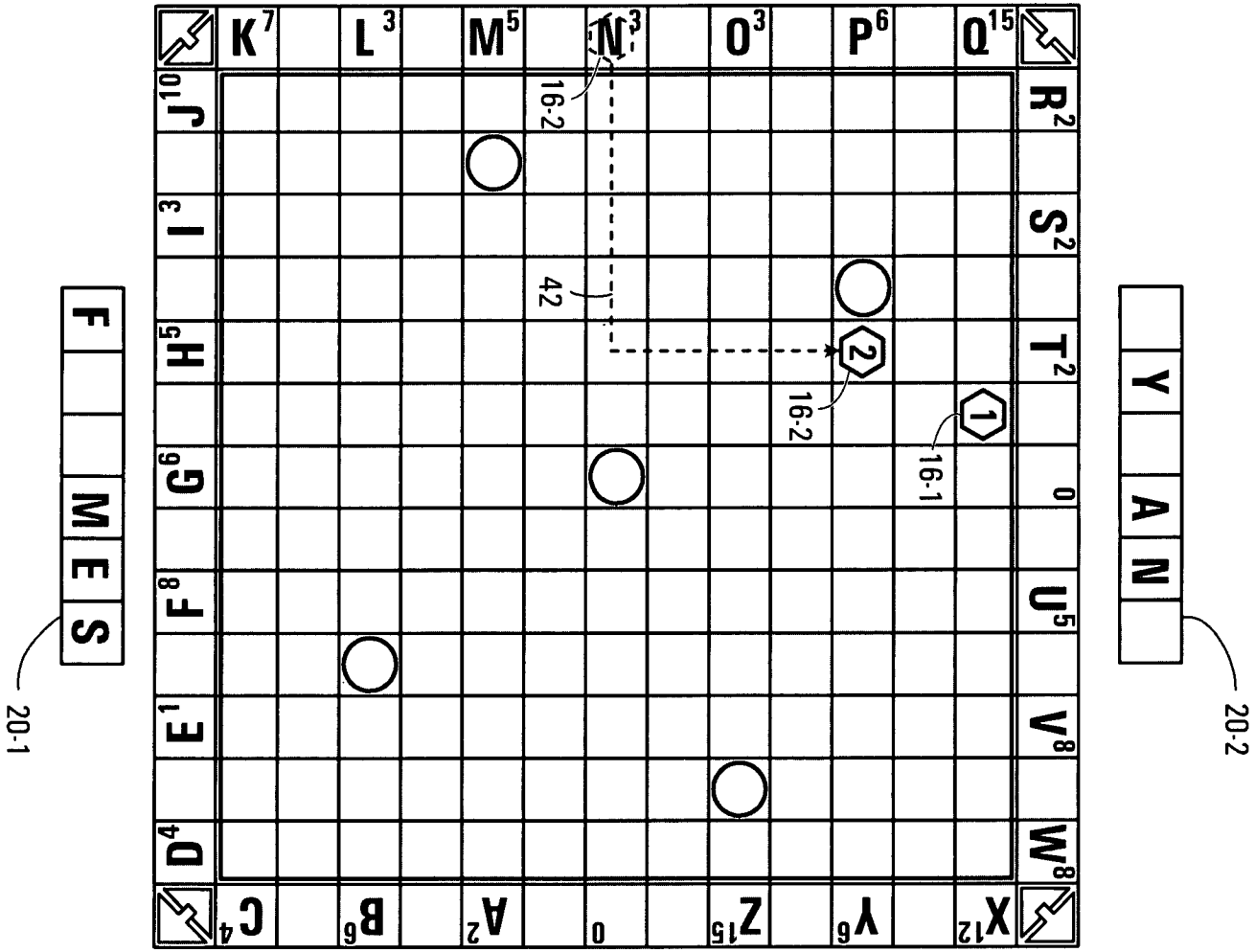
Figure 4D:
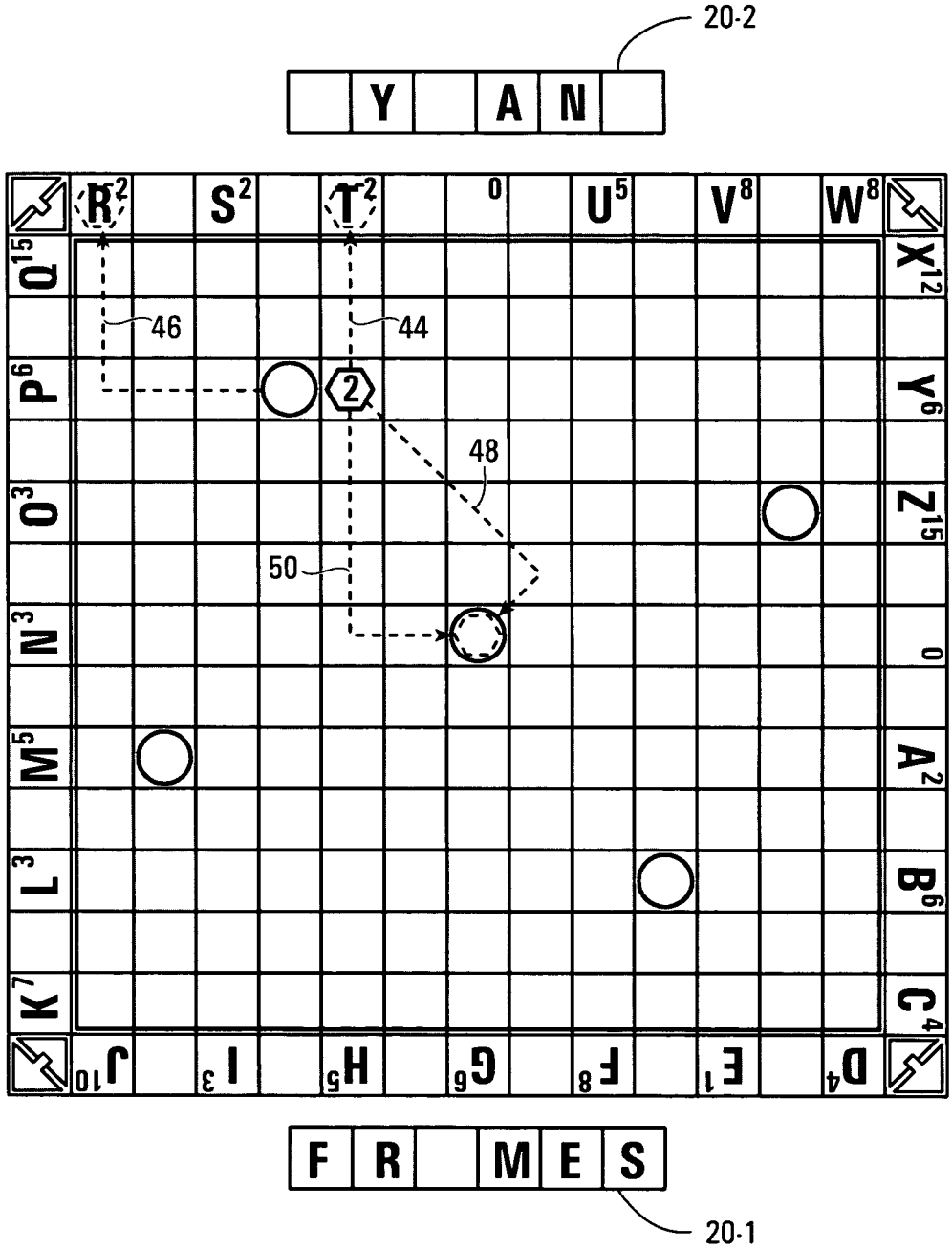

Since player 2 rolled doubles, she is entitled to a second move. Player 2 has the letters "Y" and "A" in the second and fourth letter positions on her display panel 20-2. Say she has in mind the word "TYRANT" and now rolls a 5 and a 1. She may then choose to move six squares to the peripheral point bearing the letter "N" and add this letter to her display panel—as shown in FIG. 4C. Landing on a peripheral point bearing a letter entitles a player to a further move. Say player 2 next rolls a 5 and a 4. Since a player must land by exact count on a peripheral point, player 2 is unable to advance to the peripheral point bearing the letter "R" with this roll (as this letter bearing square is eight squares distant). Player 2 may, therefore, instead decide to advance along the illustrated right angled path 42 toward the peripheral point bearing the letter "T", landing on the square whereat her token 16-2 is shown in solid line. Player 2's turn then ends. Player 2's last move will be seen to be astute since, as shown in FIG. 4D, on her next turn a count of three leads directly to the "T" (on path 44), a count of seven takes her to the "R" (on path 46) and counts of either four or six take her to the central benefit point (on paths 48, 50, respectively)—from which she may be entitled to move to any other playable point, such as the point bearing the "T" or the "R".

Figure 4E:
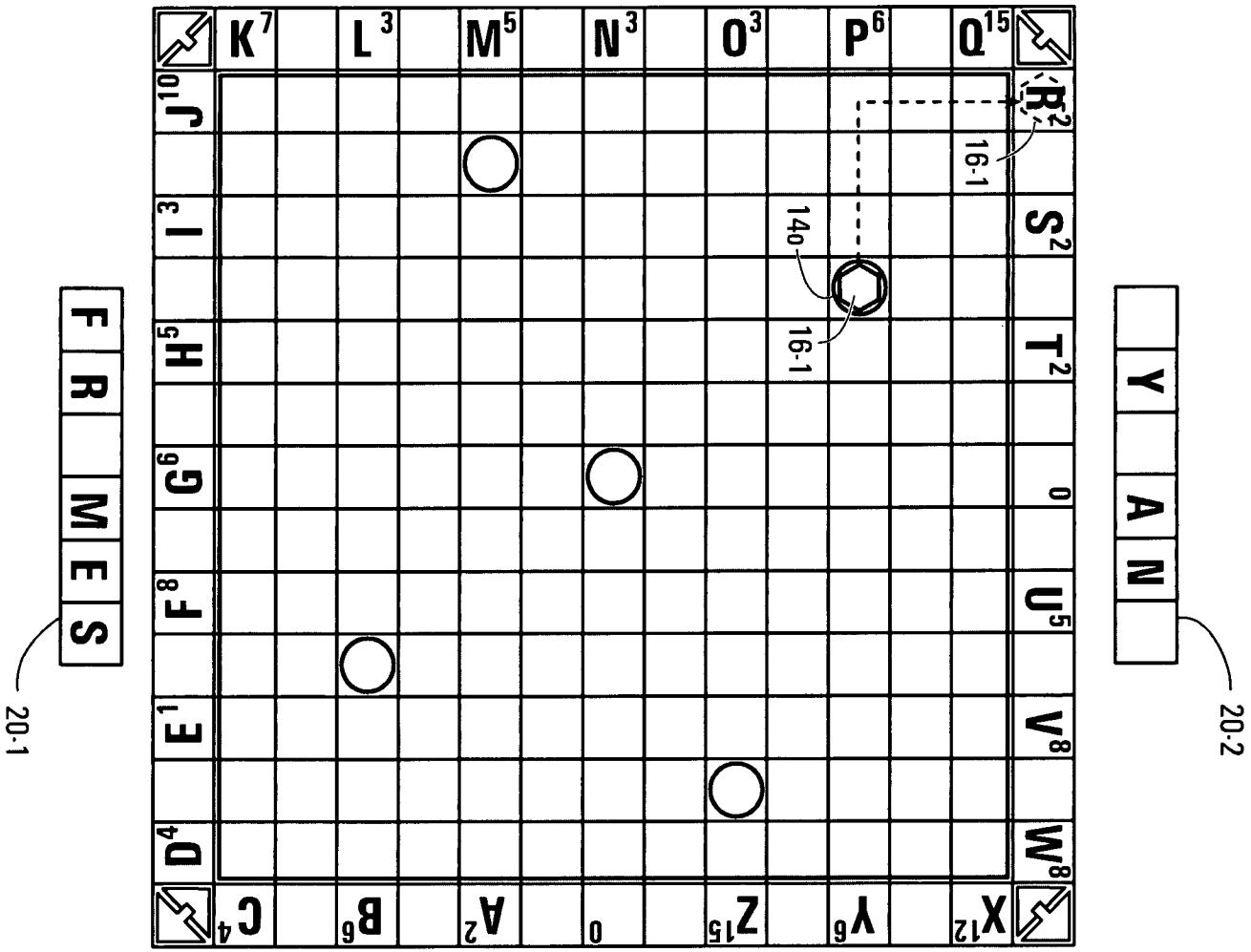

Player 1 may then roll a 5 and a 1. Player 1 may decide to move the difference of 4 to advance to benefit point 14*o*. Let us say that the benefit was a credit of one point and a further move. Say player 1 next rolls a 4 and 2. At that point, player 1 may realise he could land on the letter "R" which would be beneficial if, instead of aiming for the word "FLAMES", he aims for the word "FRAMES". Since he has collected a bonus point, he may decide he is better served by altering his strategy in this way. Player 1 therefore lands on the "R", as shown by the phantom token 16-1 in FIG. 4E. Ending on a letter entitles him to a further move. Now his strategy may be to head toward the letter "A" as quickly as possible and then off the board by landing by exact count on his designated corner square.

If player 1 succeeds in this strategy, he would then be awarded points for his word and possibly points for ending the round by being first off the board. He would obtain (8+2+2+5+1+2=) 20 points for the word "FRAMES" in view of the points associated with each letter of this word. If he were awarded five points for ending the round, his total point score for the round would be 20+5+1=26 points. Meanwhile, if player 2 had not acquired any further letters, she would be awarded (6+2+3=) 11 points for the letters "Y", "A" and "N" she had collected, to which she could add any bonus points she may have been awarded to arrive at her total for the round.

The game may end after an agreed number of rounds.

In a variation, a team of normally two players may record letters on one letter display panel so that the team co-operates to record an acceptable word. With this variation, play is arranged so that a player of a second team has a turn after a turn of a player of a first team. Further, with this variation, a token cannot end a move on a token of a teammate. This variation works well for eight players.

In another variation, each player plays with two tokens and their appropriate display panels. Each player takes turns as in the standard game. This variation is suitable for two or three players.

In a further variation, acceptable words may be of a different length, such as four or five letters long.

While the game board has been shown as a square matrix of playable squares, equally the game board may have a different configuration, such as a grid of hexagonal playable points. While the number generator has been described as a pair of dice, any other number generator could be used, such as numbered cards. While the indicia on the peripheral playable points 14*p* have been described as permanently in place on these points, alternatively, the indicia could be borne by markers placed on the peripheral playable points. In such case, a player whose token ends a move on one such marker may be entitled to remove the marker from the board and place it on his display panel.

Figure 5:
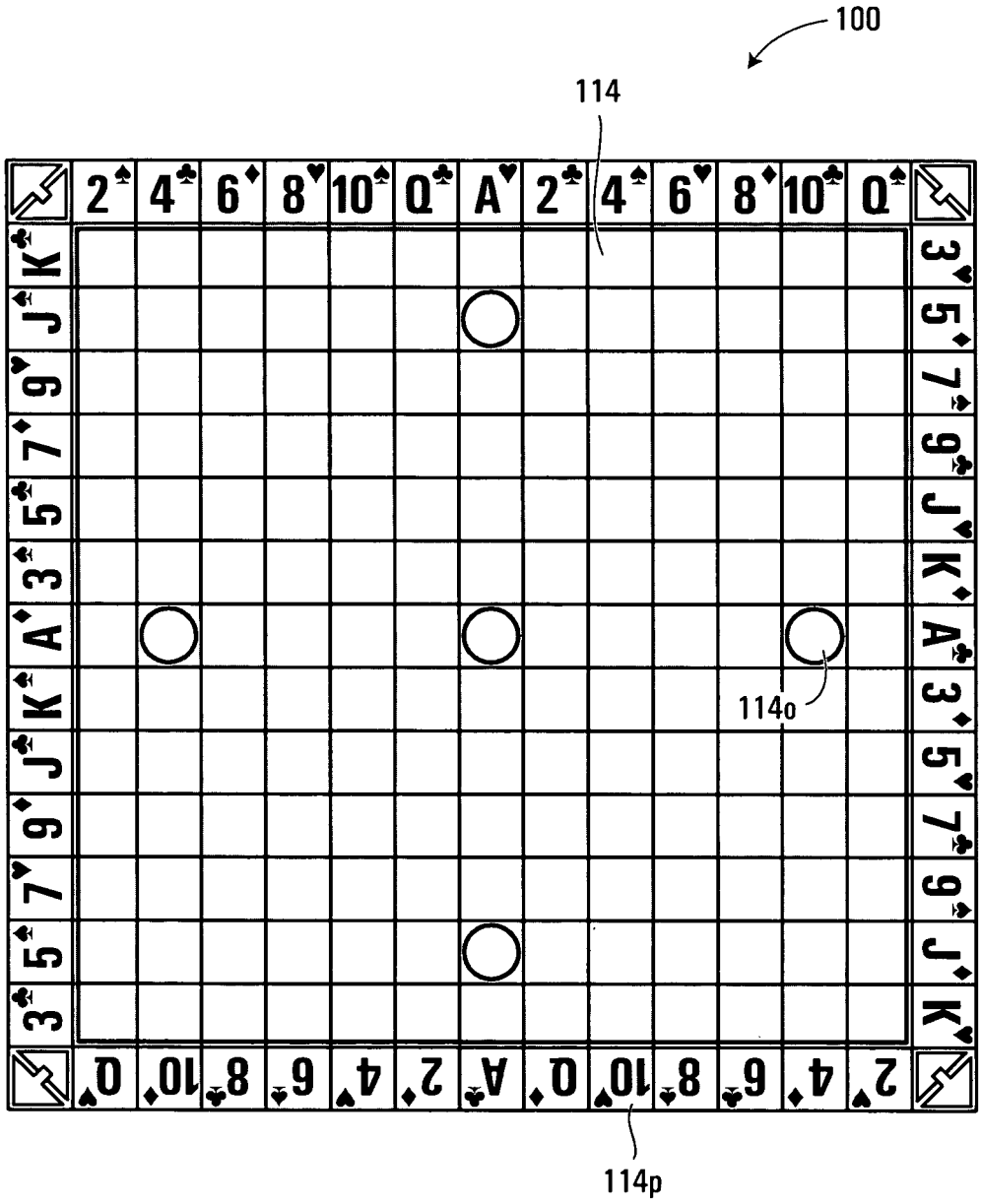
FIG. 5 is a representation of a game board made in accordance with another embodiment of this invention.

Turning to FIG. 5, in another embodiment, a game board 100 may comprise a grid of playable points 114 as before. However, the indicia of the peripheral playable points 114*p* may represent cards of a standard card deck. With this embodiment, token movement proceeds as aforedescribed. When a token ends a move on a peripheral point bearing indicia representing a card, the player records the card on his display panel (20 of FIG. 1). A player can only record any given card once on his display panel. With this embodiment, the goal is to record a five card poker hand (optionally having, at a minimum, a poker scoring value of at least one pair). On doing so, the player endeavours to exit the grid in the manner aforedescribed in conjunction with FIG. 1. Prior to a round, players may establish a pot, one-half of which is won by the player exiting first and the other half of which is won by the player with the highest poker hand when the round ends. As before, benefit points 114*o* may be used to confer a benefit on a player ending a move on a benefit point. One optional benefit could be the acquiring of a wild card (i.e., a card of the player's choosing) when ending a move on the central benefit point, or on a benefit point of a colour matching that of his token, on a roll of doubles. Players could be limited to a maximum of one wild card on their display panel.

Other modifications will be apparent to those skilled in the art and, therefore, the invention is defined in the claims.

The invention claimed is:

1. A method for playing a game comprising:

generating at least one generated number using at least one number generator; moving a token along a determined number of adjacent playable points of a game board having a grid of playable points, in any available direction, some of said playable points of said grid bearing indicia;

said determined number related to said at least one generated number;

at least for certain indicia bearing playable points, if a token of a player ends a move on one of said certain indicia bearing playable points, providing said player with an indicator of said indicia for placement on one area of a display panel associated with said player having areas for showing indicators of said indicia, wherein said move comprises two straight line segments which make an angle with each other.

2. A method for playing a game comprising:

generating at least one generated number using at least one number generator; moving a token along a determined number of adjacent playable points of a game board having a grid of playable points, in any available direction, some of said playable points of said grid bearing indicia;

said determined number related to said at least one generated number;

at least for certain indicia bearing playable points, if a token of a player ends a move on one of said certain indicia bearing playable points, providing said player with an indicator of said indicia for placement on one area of a display panel associated with said player having areas for showing indicators of said indicia, wherein said move comprises two straight line segments which make an angle with each other;

said method further comprising prohibiting said player from moving said indicator to another of said areas of said player's display panel during a round of play;

wherein said at least one number generator comprises two dice and wherein said player rolls said dice and then moves a token along a number of adjacent playable points on said grid comprising the magnitude of the difference of said two dice.

3. The method of claim 2 wherein if said move of said token ends on a playable point occupied by another token, said another token is displaced to another playable point on said board.

4. A method of playing a game having a game board having a grid of playable points, some of said playable points of said grid bearing indicia, at least two tokens for moving along said grid of playable points, and at least two display panels having areas for showing indicators of said indicia, comprising:

on a move of a player, at least for certain indicia bearing playable points, where a token ends a move on one of said indicia bearing playable points, said player receiving an indicator of said indicia and showing said indicator on one of said areas of said player's display panel and wherein said indicia are letters and further comprising, where received indicators of letters make up a word, moving toward a round ending playable point;

wherein said move of said player comprises generating at least one generated number using at least one die and moving said token along a determined number of adjacent playable points based on a number rolled by said at least one die and wherein said at least one die comprise two dice and said moving comprises moving said token the magnitude of the difference showing after a roll of said two dice.

* * * * *